United States Patent [19]

Ferris et al.

[11] Patent Number: 4,544,162

[45] Date of Patent: Oct. 1, 1985

[54] BOARD GAME UTILIZING ARTICULATED PLAYING PIECES

[75] Inventors: Michael J. Ferris; Paul H. Wise, both of Chicago; Jeffrey D. Breslow, Highland Park, all of Ill.

[73] Assignee: Marvin Glass & Associates, Chicago, Ill.

[21] Appl. No.: 520,332

[22] Filed: Aug. 4, 1983

[51] Int. Cl.[3] ..... A63F 3/00

[52] U.S. Cl. ..... 273/242; 273/288; 273/287

[58] Field of Search ..... 273/241, 255, 256, 288, 273/289, 291, 243, 262, 280, 260, 261, 249, 142 A, 247, 311, 281, 242; 434/245, 246; 63/2, DIG. 3

[56] References Cited

U.S. PATENT DOCUMENTS

| | | | |
|---|---|---|---|
| 567,218 | 9/1896 | Butler | 273/289 |
| 899,895 | 9/1908 | Patrick | 273/255 |
| 1,294,256 | 2/1919 | George | 273/262 |
| 2,298,591 | 10/1942 | Ross | 63/2 |
| 3,693,976 | 9/1972 | Flack | 273/289 |
| 4,125,262 | 11/1978 | Erickson | 273/255 |
| 4,221,388 | 9/1980 | Carini | 273/288 |
| 4,290,607 | 9/1981 | McDonald | 273/256 |
| 4,440,395 | 4/1984 | Hyland et al. | 273/241 |

FOREIGN PATENT DOCUMENTS

| | | | |
|---|---|---|---|
| 1090158 | 3/1955 | France | 273/280 |
| 224182 | 11/1924 | United Kingdom | 273/262 |

*Primary Examiner*—Richard C. Pinkham
*Assistant Examiner*—Matthew L. Schneider
*Attorney, Agent, or Firm*—John S. Pacocha

[57] ABSTRACT

A board game in which an articulated token is moveable along a serpentine path on a game board having path rows of spaces separated by intermediate zones with each intermediate zone containing an end turning space. The token has a number of disks joined together by a bead chain that permits a disk to be turned from one side to the opposite side, which is distinguished by color or other indicia, independently of the other disk segments as well as to permit the movement of the token along the serpentine path. A shooter moveable along the edge of the board is provided for hitting individual disk segments rendering them inoperable and requiring the player to turn the hit segments over to indicate their inoperability. Blocking tokens, both moveable and fixed, are also provided to protect the articulated token from being hit by the shooter as well as to hinder movement of the articulated token along the serpentine path.

13 Claims, 2 Drawing Figures

BOARD GAME UTILIZING ARTICULATED PLAYING PIECES

BACKGROUND OF THE INVENTION

1. Field of the Invention

This invention relates generally to board games and more particularly to board games that embody a theme suggested by other media or events.

2. Background Art

Board games, particularly those based on various themes suggested by real live events or occurrences, or by other games, have long been popular. For example, prior art patents assigned to the assignee of the present invention disclose board games embodying the themes of: a beauty contest, U.S. Pat. No. 3,861,686; investment, U.S. Pat. No. 3,865,379; invention, U.S. Pat. No. 3,885,792; golf, U.S. Pat. No. 3,989,249; magic acts, U.S. Pat. No. 3,989,251; fast food franchises, U.S. Pat. No. 3,994,499; and the legendary creature "BIG FOOT" U.S. Pat. No. 4,128,246. Recently, video games, both the types playable in arcades and by means of adapters on home television sets, have become popular pastimes. Such video games have also provided themes for board games. There are currently board games based on the Bally/Midway "PAC-MAN", Nintendo "DONKEY KONG" and Sega "FROGGER" video games which are disclosed respectively in copending applications Ser. Nos. 339,850 filed Jan. 18, 1982, now U.S. Pat. No. 4,448,421; 424,354 filed Sept. 27, 1982 now U.S. Pat. No. 4,484,747; and 426,368 filed Sept. 29, 1982 which was abandoned upon filing continuation application Ser. No. 638,531 on Aug. 6, 1984, all of which are assigned to the assignee of the present invention. There remains, however, a need for additional portable board games that provide entertaining, challenging and competitive play of a game employing a theme suggested by popular video games. Moreover, since some of the characters in video games have a number of different parts or segments, there is a need to simulate such characters in the token used by a player in a board game in order to best embody the themes of such video games in the board game.

SUMMARY OF THE INVENTION

The present invention is concerned with providing a portable board game for competitive play that employs the theme of a player shooting segments of an adversary character advancing in a serpentine path and which includes an articulated token or piece for movement on the game board. These and other objects and advantages of the invention are achieved by a board game having a board with a serpentine path of rows of playing spaces along which the token moves skipping all but an end turning space in the zones intermediate the path rows. The token has a plurality of disk segments with the opposed sides distinguished by color or other indicia joined together by bead chain permitting each disk to be changed from one side to the other independently of the other disks. In each intermediate zone a raised disk is provided adjacent the end turning spaces to facilitate moving the token from one path row to the next path row. A simulated shooter piece is provided for hitting segments of the articulated token aligned with the shooter. Both stationary and moveable shield, block the shooter to provide safe spaces for segments of the articulated token. Additional, pieces are also provided for affecting the play of other game pieces. Movement of the token is determined by the number of segments that are not "dead" after being shot. If the forward or head end disk is "dead", movement of the articulated token is prohibited. To facilitate keeping track of a player's remaining turns or lives the shooter carries an indicator.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
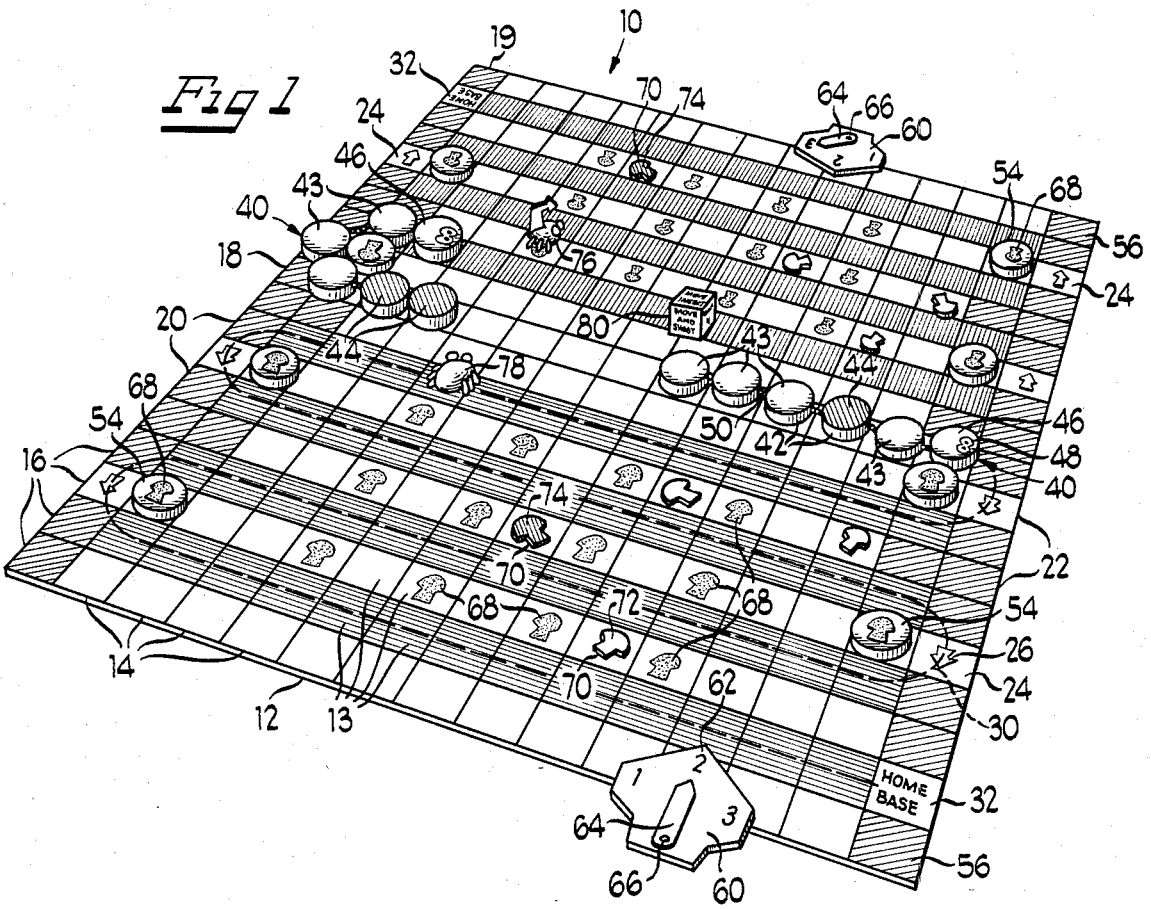
FIG. 1 is a perspective view of an embodiment of the present invention.
Figure 2:
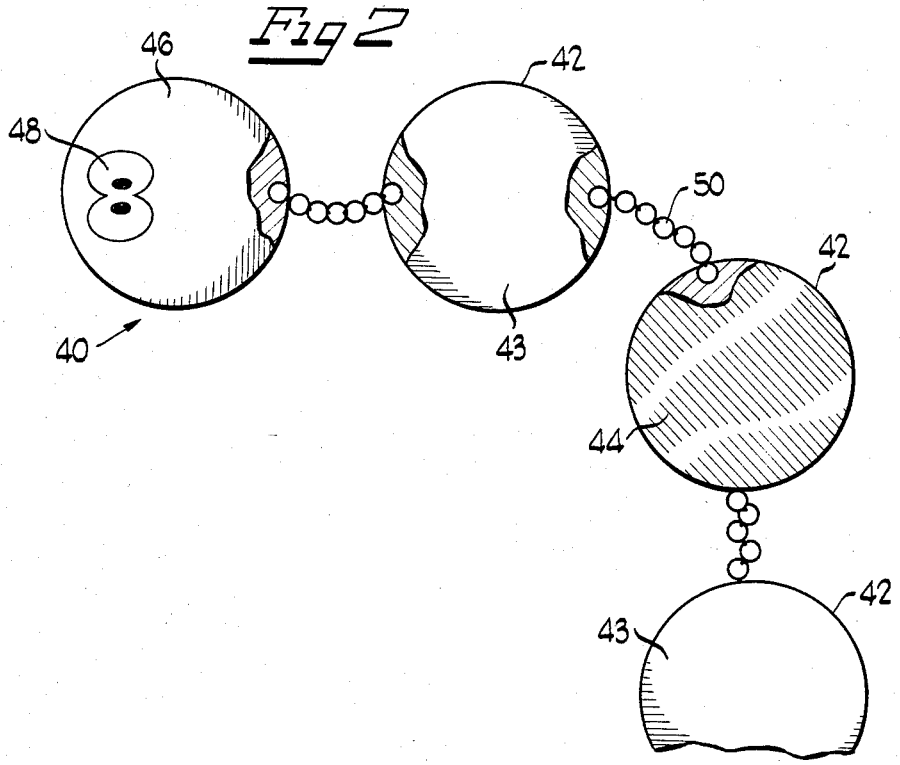
FIG. 2 is an enlarged view of the articulated token shown in FIG. 1 with some of the disk segments partially in section.

Referring now to the drawings in which like parts are designated by like reference numerals throughout the several views, there is shown in FIG. 1 a board game 10 which includes a rectangular game board 12. The playing field on the game board is divided into a grid work of spaces 13 forming files 14 and rows 16. As an alternative, the grid work could be provided with an even number of rows 16 and be symmetrical about a centerline rather than a center row.

On either side of the center row 18 the spaces 13 in every other row except for the spaces in the end files 19 is designated as a path row 20 by means of color or some other indicia. In each of the intermediate zones 22, between the path rows 20 one end space 24 is designated by suitable indicia such as the arrow 26 as a turning space for movement from one path row to the next path row. The turning space 24 at the end of the next intermediate zone 22 is at the opposite end from the turning space in the preceding intermediate zone providing for movement of a token along a serpentine path 30 from the middle of the board or the center row 18 to a finish space 32 which may be designated as "Home Base" as shown in FIG. 1. Except for the turning spaces 24 the end files 19 are not used for movement of a player token.

Each player is provided with an articulated token or piece 40 moving along the serpentine path 30. Token 40 comprises a number of connected disks 42. A total of six disks for each of the tokens 40 has been found to be a convenient number to provide for an entertaining and challenging game of suitable length. The two opposed flat sides of each disk 42 are distinguished by means of color or other indicia. As illustrated in FIG. 1, most of the disks have the "live" side 43 facing up while three of the disks have the opposite "dead" side 44 showing. In addition one of the end disks is designated as the forward end or head 46 of the token by means of artwork such as the eyes 48 although other means including a slightly different shape for the head disk could be employed.

A length of bead chain 50 connects each disk to each adjacent disk to provide a connecting joint between each disk. Chain 50 permits the token 40 to be moved along the serpenting path 30, as illustrated for one of the tokens 40 in FIG. 1, and also permits each disk or segment 42 to be turned over independently of each other disk to expose "live" side 43 or the opposite "dead" side 44. To facilitate turning the token 40 from one path row 20 to the next path row 20 through the turning space 24 of the intermediate zone 22, a turning disk 54 is provided in the intermediate zone adjacent each turning space 24. The disks 54 are similar to the disks 42 used in the token 40.

The peripheral row 56 along each opposed edge of the game board 12 beneath the path row 16 having the home base space 32 is provided for movement of a simulated shooter piece 60 between the side peripheral files 19. The shooter 60 is provided with a gun or pointer portion 62 so that it may readily be determined along which file of spaces the shooter is aligned. In addition, the shooter may carry an indicator in the form of a pointer 64 secured for movement about a pin or rivet 66 to pivot among designations such as "1", "2" and "3" on the face of the shooter 60 to indicate the remaining turns or lives a player has.

In the embodiment shown and described the shooter 60 is prohibited by rule from moving into alignment with the peripheral files 19. Thus, the articulated token 40 is protected from being shot while in the turning space 24 within a peripheral file 19. As an alternative, structural stops (not shown) could be provided to preclude the shooter from moving into alignment with a peripheral file 19. To some extent, the physical configuration of the shooter 60 in the embodiment shown and described does prohibit such alignment without a portion of the shooter 60 hanging over beyond the side edge of the board 12 if the pointer or gun portion 62 is within the peripheral file 19.

Additional protection for the token 40 is provided by blocking shields that are permanently positioned as indicia 68 on the board 12 within the intermediate zones 16 including the indicia 68 on the turning disks 54. If a shield 68 is between the point 62 of the shooter and a disk 42 the disk may not be hit. Moveable pieces 70 are also provided for blocking the shooter. The moveable blocking pieces have two opposed sides 72 and 74 which may be distinguished by color or other indicia. Further pieces in a form of a bug 76 and an insect 78 are also provided for movement on the board to interact with the play of other pieces and to change the effectiveness of those pieces.

A chance device in a form of six sided die 80 is provided for determining movement of the pieces. The die 80 contains the following indicia: "Move Snake;" "Move and Shoot" (on two faces); "Move Insect;" "Move Bug" and "Head Up." At the start of play each articulated snake token 40 is placed along the center row 18 with the head disk 46 in a space adjacent the peripheral file 19. Each player is provided with four of the blocking pieces 70 which the player places with side 72 facing upwardly in the intermediate zones 22 between fixed or stationary shield indicia 68. The insect 78 is placed on the open space in the center row 18 and the bug 76 remains off the board until the first roll of "Move Bug" on the die 80. Each player's gun or shooter 60 starts in the peripheral file 19 containing the "Home Base" space 32 closest to the player. One of the players is chosen to start the game such as the first one to roll "Move Snake".

Rolling one of the two "Move and Shoot" die faces up allows the player to move the shooter 60 anywhere along the edge row 56 to a space other than in the peripheral files 19 that the player elects. The gun 60 is then automatically shot and, if the player hits a "live" segment of the opponent's token 40, that segment is turned over to the "dead" side 44 and the successful shooting player may turn a "dead" disk on the player's own token 40 back to the "live" side 43. If a stationary shield 68 or a moveable blocking piece 70 is between the point 62 of the player's shooter and the opponent's token segment, the shield or block is hit and the opponent's token 40 is not hit. Should the shield or block that is hit be moveable piece 70 with the side 72 facing upwardly, the player may remove that piece and save it for later use. Hitting an opponent's shooter or gun 60 results in a loss of one to three turns or lives. As an alterative method of play, hitting the opponent's shooter could result in return of the shooter to beneath the "Home Base" indicia 32 and the loss of use of the shooter for one round.

Either shooting the insect 78 or rolling "Move Insect" on the die 80 entitles the player to move the insect 78 anywhere on the path row 20 to block movement of the opponent's token 40. When a player shoots the bug 76 or rolls "Move Bug" on the die 80, the player may place the bug 76 in an intermediate zone to block the shots of the opponent. Placing the bug 76 on a moveable blocking token 70 having the side 72 facing upwardly entitles the player to turn the token over to expose the opposite side so that token 70 may no longer be removed from the board when hit by the shooter 60. In addition, if the player entitled to move the bug has previously shot and saved a piece 70, the player may use the bug 78 to place such a saved piece in an intermediate zone 22 in a position that is fixed for the rest of the game with the side 74 facing upwardly.

When a player rolls "Move Snake" the player may move token 40 along the serpentine path 30 the number of spaces for which the player has disks with their "live" sides 43 facing up. Thus, at the start of the game a player rolling "Move Snake" may, using the head disk 46 to count, move the token 40 six spaces. Once a disk is turned over to the opposite "dead" side 44 that disk may not be used to count the number of spaces which the player is entitled to move the token. Should the head disk 46 be shot and turned over to the "dead" side 44, the player may not move the token 40 until the player either rolls "Head Up" on die 80 or succeeds in shooting the opponent's token head disk 46. A player may resurrect other disk segments by shooting any disc segment of the opponent's token entitling the player to turn over a previously shot "dead" disk of the player's own token back to the "live" side 43. The first player to move the assigned token 40 to "Home Base" wins the game.

While a particular embodiment of the present invention is shown and described, changes and modifications will occur to those skilled in the art. It is intended in the appended claims to cover all such changes and modifications as fall within the true spirit and scope of the present invention.

What is claimed as new and desired to be secured by Letters Patent is:

1. A board game comprising:

a planar game board with turning means defining a serpentine path of contiguous spaces consisting of generally parallel, spaced apart, path rows with ends and generally semicircular alternating turns connecting ends of adjacent path rows;

at least one articulated token moveable on the game board;

the token having a plurality of segments including a forward segment and a rearward segment with joint means connecting each segment to each adjacent segment;

each segment being a flat piece having two sides and the joint means permitting each segment to be changed from one side to the other side independently of the other segments; and the turning means including disks disposed adjacent the inside of each semicircular turn and projecting upwardly from the planar game board to provide a bearing to facilitate turning of the token from one path row to an adjacent path row.

2. The board game of claim 1 in which the joint means is a length of chain.

3. The board game of claim 1 in which the joint means is a length of bead chain.

4. The board game of claim 1 in which each segment is a disk.

5. The board game of claim 1 in which the segments have indicia distinguishing one side from the other side.

6. The board game of claim 1 including indicia on the game board designating a finish space at the end of a path row opposite the end adjacent the semicircular turn from the preceding path row and wherein an intermediate zone is located between pairs of adjacent path rows.

7. The board game of claim 6 including a shooter slidable along the edge of the board adjacent the path row having the finish indicia for hitting a segment of the token in line with the shooter.

8. The game board of claim 7 including blocking means located between the ends of the intermediate zones for preventing the shooter from hitting a segment of the token on the opposite side of an aligned blocking means.

9. The board game of claim 8 in which the blocking means are indicia on the game board.

10. The board game of claim 8 in which the blocking means are moveable pieces.

11. The board game of claim 8 in which the intermediate zone comprises a turning space adjacent said turning means and wherein said shooter is precluded from hitting a segment of the token in the turning space.

12. The board game of claim 8 in which the token is prevented from moving when the forward end segment is hit by the shooter.

13. The board game of claim 1 including a moveable shooter bearing a moveable indicator of remaining turns.

* * * * *